US011260502B2

(12) United States Patent
Schadow et al.

(10) Patent No.: US 11,260,502 B2
(45) Date of Patent: Mar. 1, 2022

(54) HAND-HELD POWER TOOL HAVING AT LEAST ONE MACHINE-SIDE CONTACT ELEMENT

(71) Applicant: Robert Bosch GmbH, Stuttgart (DE)

(72) Inventors: Joachim Schadow, Stuttgart (DE); Joern Stock, Leinfelden-Echterdingen (DE); Florian Esenwein, Leinfelden-Echterdingen (DE)

(73) Assignee: Robert Bosch GmbH, Stuttgart (DE)

( * ) Notice: Subject to any disclaimer, the term of this patent is extended or adjusted under 35 U.S.C. 154(b) by 638 days.

(21) Appl. No.: 15/775,595

(22) PCT Filed: Nov. 2, 2016

(86) PCT No.: PCT/EP2016/076374
§ 371 (c)(1),
(2) Date: May 11, 2018

(87) PCT Pub. No.: WO2017/092947
PCT Pub. Date: Jun. 8, 2017

(65) Prior Publication Data

US 2018/0326554 A1 Nov. 15, 2018

(30) Foreign Application Priority Data

Dec. 2, 2015 (DE) ..... 10 2015 224 006.1

(51) Int. Cl.
*B24B 55/05* (2006.01)
*B25F 5/02* (2006.01)
(Continued)

(52) U.S. Cl.
CPC ..... *B24B 55/052* (2013.01); *B24B 23/022* (2013.01); *B24B 23/028* (2013.01);
(Continued)

(58) Field of Classification Search
CPC ..... B24B 55/04; B24B 55/05; B24B 55/052; B24B 23/028; B24B 23/022; B23Q 11/06; B25F 5/026; H01H 3/20; H01H 3/28
See application file for complete search history.

(56) References Cited

U.S. PATENT DOCUMENTS 4,683,682 A 8/1987 Pennison
5,022,188 A * 6/1991 Borst ..... B24B 23/022 451/342
(Continued)

FOREIGN PATENT DOCUMENTS

DE 3313704 A1 10/1984
DE 197 07 215 A1 9/1997
(Continued)

OTHER PUBLICATIONS

International Search Report corresponding to PCT Application No. PCT/EP2016/076374, dated Feb. 8, 2017 (German and English language document) (7 pages).

*Primary Examiner* — Joel D Crandall
(74) *Attorney, Agent, or Firm* — Maginot, Moore & Beck LLP

(57) ABSTRACT

A hand-held power tool, in particular an angle grinder, includes a gearing housing part and an accessory equipment. The gearing housing part includes at least one machine-side contact element. The accessory equipment includes at least one accessory equipment-side contact element. In the mounted state of the accessory on the hand-held power tool, the at least one machine-side contact element comes into contact with the at least one accessory-side contact element.

14 Claims, 6 Drawing Sheets

(51) Int. Cl.

| | |
|---|---|
| ***B24B 23/02*** | (2006.01) |
| ***H01H 3/20*** | (2006.01) |
| ***H01H 9/28*** | (2006.01) |
| ***H01H 9/06*** | (2006.01) |
| ***H01H 3/58*** | (2006.01) |

(52) U.S. Cl.
CPC ..... *B25F 5/026* (2013.01); *H01H 3/20* (2013.01); *H01H 9/28* (2013.01); *H01H 3/58* (2013.01); *H01H 9/06* (2013.01)

(56) References Cited

U.S. PATENT DOCUMENTS

| | | | | |
|---|---|---|---|---|
| 5,681,214 | A * | 10/1997 | Kleider | B23D 45/16 451/344 |
| 6,386,961 | B1 | 5/2002 | Cureton | |
| 2002/0123301 | A1* | 9/2002 | Chi | B24B 45/00 451/344 |
| 2002/0182991 | A1 | 12/2002 | Hung | |
| 2003/0190877 | A1* | 10/2003 | Gallagher | H02K 3/00 451/344 |
| 2006/0219419 | A1 | 10/2006 | Sugiyama et al. | |
| 2007/0108035 | A1* | 5/2007 | Broghammer | B25F 5/00 200/522 |
| 2008/0014844 | A1 | 1/2008 | Pontieri | |
| 2014/0080388 | A1* | 3/2014 | Lutz | B24B 23/028 451/344 |
| 2014/0158391 | A1* | 6/2014 | Xin | B24B 23/028 173/170 |
| 2018/0281146 | A1* | 10/2018 | Tomonaga | B24B 23/022 |

FOREIGN PATENT DOCUMENTS

| | | | | |
|---|---|---|---|---|
| DE | 19707215 | A1 * | 9/1997 | H01H 3/20 |
| DE | 10 2007 060 041 | A1 | 6/2009 | |
| DE | 102013202832 | A1 | 8/2014 | |
| DE | 10 2013 215 821 | A1 | 2/2015 | |
| GN | 1319477 | A | 10/2001 | |
| GN | 2486419 | Y | 4/2002 | |
| JP | H09-290377 | A | 11/1997 | |
| WO | WO-2004087377 | A1 * | 10/2004 | B23Q 11/06 |
| WO | WO-2012040891 | A * | 4/2012 | B25F 5/001 |

* cited by examiner

10

HAND-HELD POWER TOOL HAVING AT LEAST ONE MACHINE-SIDE CONTACT ELEMENT

This application is a 35 U.S.C. § 371 National Stage Application of PCT/EP2016/076374, filed on Nov. 2, 2016, which claims the benefit of priority to Serial No. DE 10 2015 224 006.1, filed on Dec. 2, 2015 in Germany, the disclosures of which are incorporated herein by reference in their entirety.

The disclosure relates to a portable power tool having at least one machine-side contact element.

BACKGROUND

Portable power tools, in particular angle grinders, are already known from the prior art.

SUMMARY

The portable power tool according to the disclosure is configured in particular as an angle grinder. In portable power tools of this kind, a particular requirement is to increase the safety for an operator of the portable power tool. This includes, inter alia, monitoring as to whether safety-relevant accessories such as a protective hood or an auxiliary handle have been fitted.

The portable power tool according to the disclosure has at least one transmission housing part. A safety-relevant accessory has, according to the disclosure, at least one accessory-side contact element. It is proposed that the machine-side contact element and the accessory-side contact element be releasably connectable together. It is thus advantageously possible to ensure that the safety-relevant accessory can be fitted on the portable power tool.

By way of the features specified in the dependent claims, advantageous developments of the fastening unit according to the disclosure are possible.

In one advantageous embodiment, the accessory is configured as an auxiliary handle. The auxiliary handle is advantageously provided in particular to be gripped by an operator of the portable power tool. In this way, the safety of using the portable power tool can advantageously be increased in that the portable power tool is operated with two hands.

In a further advantageous embodiment, the accessory is embodied as a protective hood. The protective hood is advantageously intended to protect an operator of the portable power tool, when the portable power tool is in operation, from sparks and/or material particles which arise during operation of the portable power tool, and/or from fragments, thrown out with great force, of a disk that has shattered during operation.

Advantageously, a blocking element is arranged in the transmission housing part, said blocking element being intended to block a mechanical element when the accessory is not fitted, such that the portable power tool cannot be switched on. In this way, safe operation of the portable power tool can advantageously be ensured.

According to the disclosure, the mechanical element is embodied as a switch element. Advantageously, the switch element is arranged in the motor housing part. If the blocking element has a stop, the sliding switch moves against the stop of the blocking element when the accessory is not fitted. This advantageously ensures that the portable power tool is not switched on when the accessory is not fitted. As a result, safe operation of the portable power tool is advantageously ensured.

In one advantageous embodiment, the mechanical element is embodied as a mechanical shaft, in particular as a motor shaft.

In a further advantageous embodiment, the mechanical element is embodied as an output shaft, in particular as a spindle.

According to the disclosure, the blocking element has a rotary joint.

Advantageously, with the accessory fitted, the blocking element is subjected to a force and moved about an axis of rotation of the rotary joint. Thus, as a result of the blocking element being rotated about the axis of rotation of the rotary joint, the stop of the blocking element can advantageously be moved such that the sliding switch can switch on the portable power tool (10).

Further advantageous and expedient embodiments can be gathered from the description of the FIGS. and from the drawings.

BRIEF DESCRIPTION OF THE DRAWINGS

Embodiments of a portable power tool according to the disclosure are shown in the drawings.

In the drawings.

DETAILED DESCRIPTION

Figure 1:
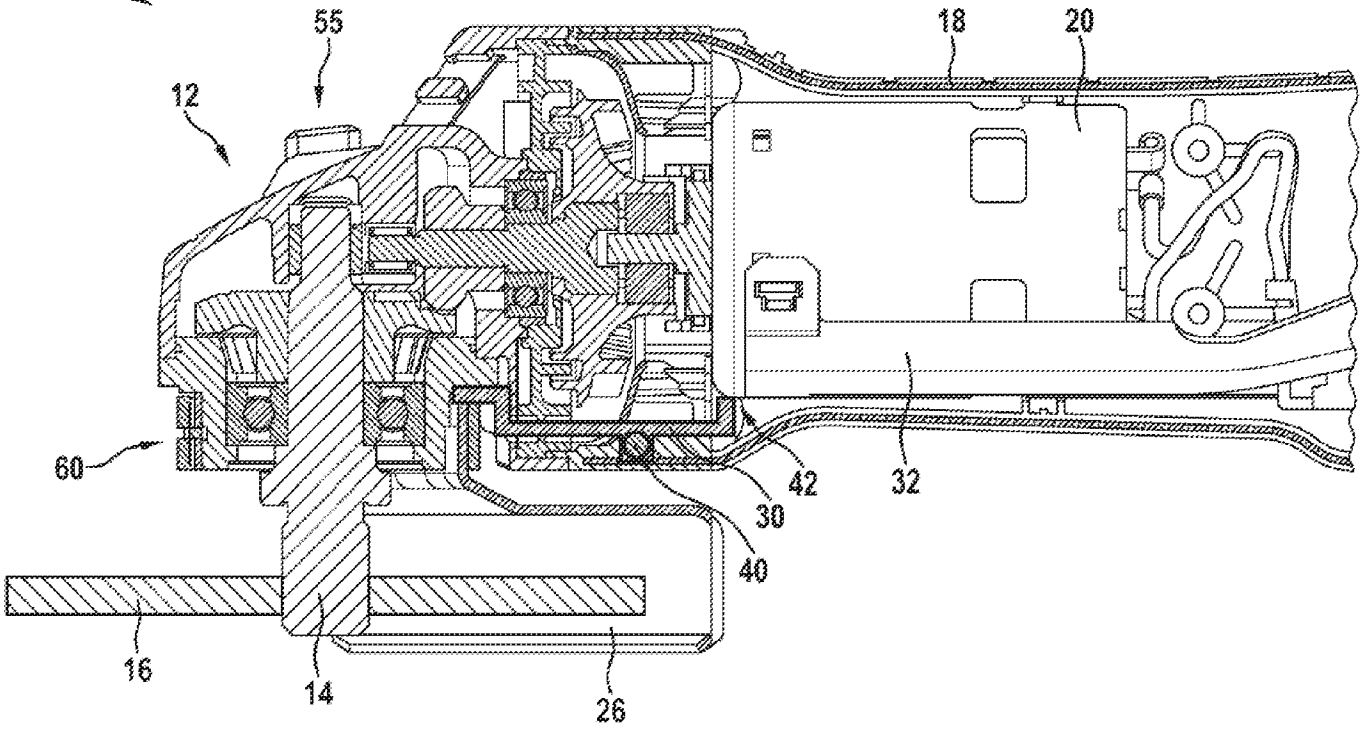
FIG. 1 shows an arrangement of a portable power tool according to the disclosure and of a contact element in a schematic illustration.

The same reference numerals are used for the same components that appear in the different embodiments.

FIG. 1 shows a portable power tool 10. The portable power tool is an angle grinder, which usually has a transmission housing part 12 that accommodates an angular transmission. From the angular transmission there protrudes a working spindle 14, on which a grinding and/or cut-off tool 16 is mounted. The angle grinder has a motor housing part 18 for receiving an electromotive drive unit 20.

Figure 2:
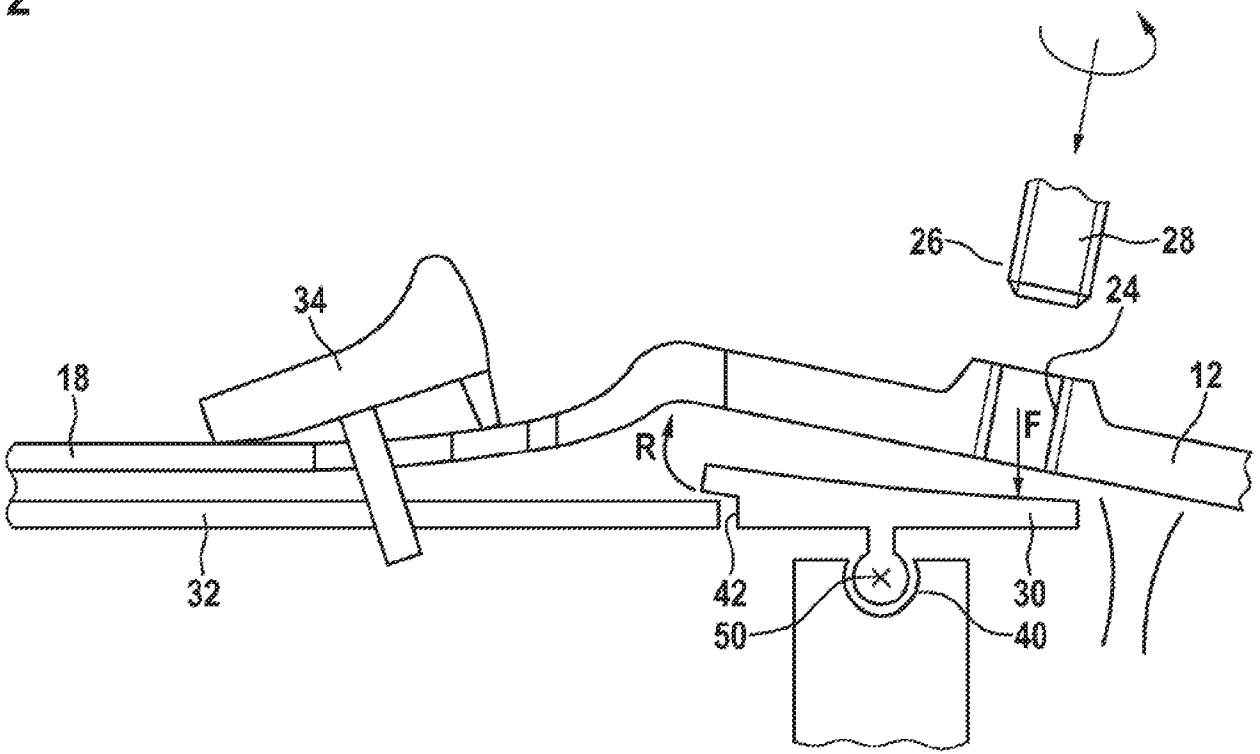
FIG. 2 shows a first detail of a portable power tool and a first detail of an associated accessory in a schematic illustration.

As can be seen in FIG. 2, a machine-side contact element 24 is arranged in the transmission housing part 12. Machine-side means that the contact element 24 is arranged in the portable power tool 10. In the exemplary embodiment according to FIG. 2, the machine-side contact element 24 is a screw thread. In the exemplary embodiment, the screw thread 24 is arranged in the transmission housing 12. However, it is also conceivable for the machine-side contact element 24 to be arranged in the motor housing part 18. It is also conceivable for more than one machine-side contact element 24 to be arranged in the portable power tool 10.

An accessory 26 is intended to be connected to the portable power tool 10. The accessory 26 has an accessory-side contact element 28. Accessory-side means that the contact element 28 is arranged in the accessory 26 for the portable power tool 10. In the exemplary embodiment according to FIG. 2, the accessory 26 is an auxiliary handle 26*a* for the portable power tool 10. As the accessory-side contact element 28, the auxiliary handle 26*a* has a threaded pin 29, which is screwed into the screw thread 24 of the transmission housing part 12. In the embodiment according to the disclosure, the machine-side contact element 24 and the accessory-side contact element 28 are releasably connectable together.

Figure 3:
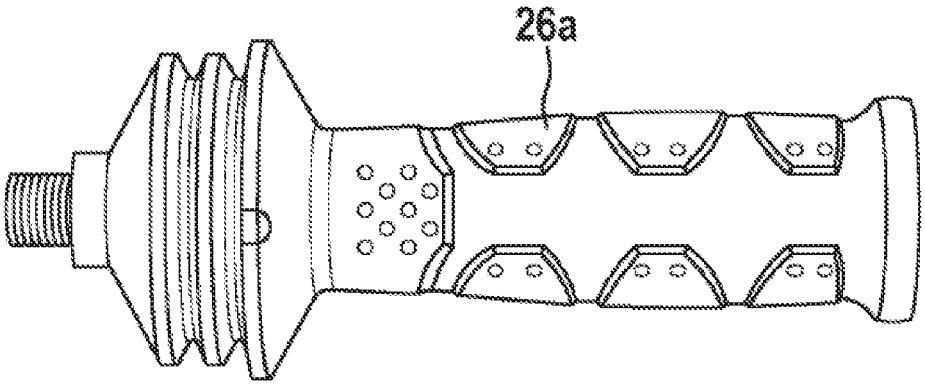
FIG. 3 shows two embodiment of an accessory of the portable power tool according to the disclosure in a schematic illustration.

As illustrated in FIG. 3, the accessory 26 for the portable power tool 10 is embodied as an auxiliary handle 26*a* or as a protective hood 26*b*. The auxiliary handle 26*a* is intended to be gripped by an operator of the portable power tool such that the portable power tool 10 has to be operated with two hands.

The object of the protective hood 26*b* is to protect an operator of the portable power tool 10, when the portable power tool 10 is in operation, from sparks and/or material particles which arise during operation of the portable power tool, and/or from fragments, thrown out with great force, of a disk that has shattered during operation.

As can be seen in FIG. 1, a blocking element 30 is arranged in the transmission housing part 12. A mechanical element 32 is arranged next to the blocking element 30. The mechanical element 32 is intended to ensure the operation of the portable power tool 10. The blocking element 30 is intended to block the mechanical element 32 when the accessory 26 is not fitted, such that the portable power tool 10 cannot be put into operation.

The mechanical element 32 is a switch element 32 in the exemplary embodiment in FIG. 1. FIG. 2 shows a detail view. The switch element 32 is intended to switch on the electromotive drive unit 20 when a switch 34 is actuated. In the exemplary embodiment according to FIG. 2, the switch element 32 is configured as a sliding switch. When the accessory 26 is not fitted, for example when an auxiliary handle 26*a* is not fitted, the sliding switch 32 cannot be moved, when the switch 34 is actuated, in order to switch on the electromotive drive unit 20, and so the portable power tool 10 cannot be switched on.

In the exemplary embodiment according to FIG. 1, the blocking element 30 is embodied as a tilting element having a rotary joint 40. The blocking element 30 has a stop 42.

When the auxiliary handle 26*a* is not fitted, the sliding switch 32 is not movable further in the direction of the transmission housing 12, since it moves against the stop 42 of the blocking element 30. If the auxiliary handle 26*a* is fitted, the blocking element 30 is subjected to a force F. The blocking element 30 rotates about an axis of rotation 50 of the rotary joint 40 in the process. As a result of the blocking element 30 rotating about the axis of rotation 50 of the rotary joint 40, the stop 42 of the blocking element 30 rotates in a direction R and is no longer an obstacle for the sliding switch 32. In the case of the fitted auxiliary handle 26*a*, the sliding switch 32 can accordingly be moved in the direction of the transmission housing 12 and switch on the portable power tool 10.

A restoring force ensures that the blocking element 30 returns into its starting position when the auxiliary handle 26*a* is removed. The restoring force can be created in that the blocking element 30 is elastically deformable. However, it is also conceivable for an additional element (not shown), for example a restoring spring, to be integrated.

Furthermore, FIG. 1 shows two variants in which the fitting of the protective hood 26*b* is carried out.

The protective hood 26*b* has a protective hood collar 60. If the protective hood 26*b* and thus the protective hood collar 60 is fitted on the portable power tool 10, the blocking element 30 is actuated, said blocking element 30 rotating about its axis of rotation 50 of the rotary joint 40. As a result of the blocking element 30 being rotated about the axis of rotation 50 of the rotary joint 40, the stop 42 of the blocking element 30 rotates in a direction R and is no longer an obstacle for the sliding switch 32. In the case of the fitted auxiliary handle 26*a*, the sliding switch 32 can accordingly be moved in the direction of the transmission housing 12 and switch on the portable power tool 10.

Figure 4:
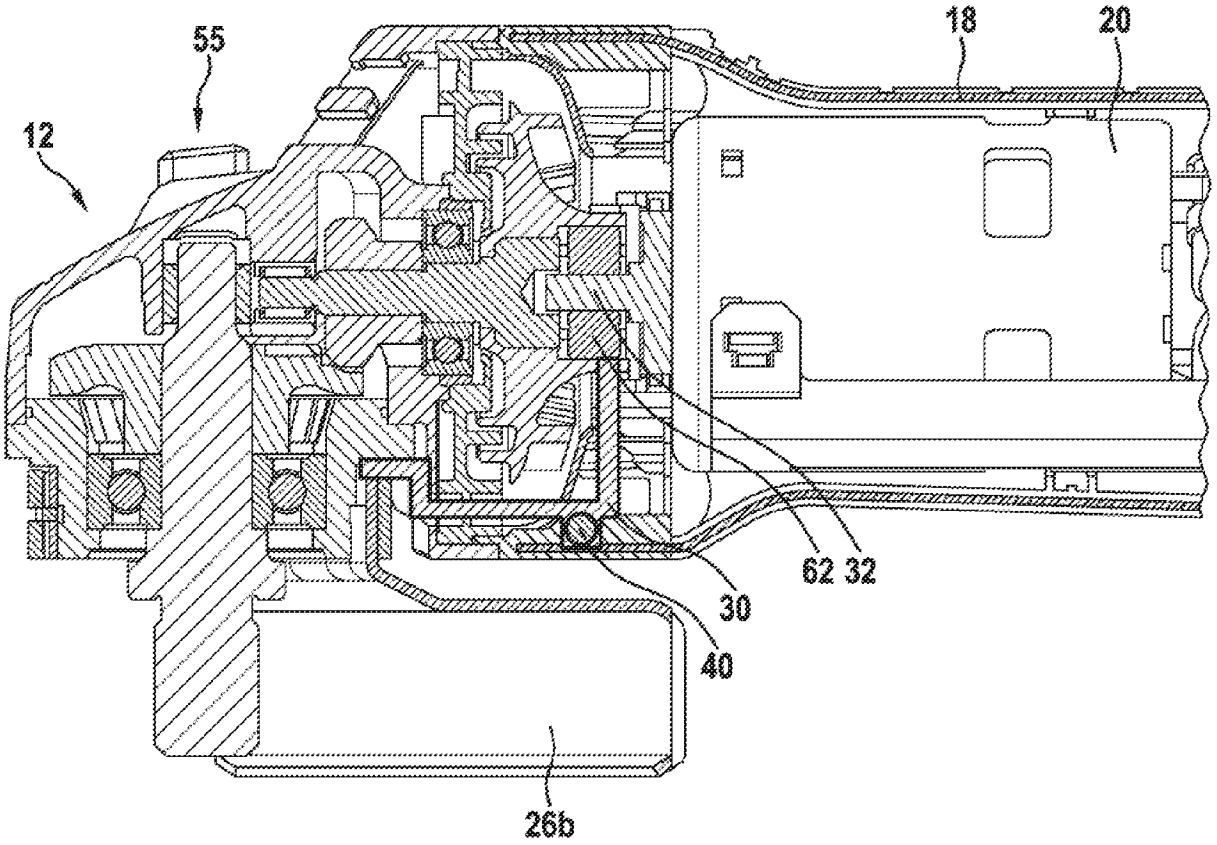
FIG. 4 shows a second embodiment of the portable power tool according to the disclosure and of the contact element in a schematic illustration.

FIG. 4 shows a further embodiment of a portable power tool 10 having a blocking element 30 and a mechanical element 32.

In the exemplary embodiment in FIG. 4, the mechanical element 32 is a motor shaft 32, The motor shaft 32 is intended to transmit a rotary movement to an output shaft, via a transmission. When the accessory 26 is not fitted, for example when a protective hood 26*b* is not fitted, the motor shaft 32 is blocked and so the portable power tool 10 cannot be put into operation. In this case, a form fit is formed between a toothed sleeve 62 and the blocking element 30. In the exemplary embodiment according to FIG. 4, the blocking element 30 is embodied with a rotary joint 40. If the protective hood 26*b* is fitted, the blocking element 30 is moved about the rotary joint 40, with the result that the form fit between the blocking element 30 and the toothed sleeve 62 is undone.

A restoring force ensures that the blocking element 30 returns into its starting position when the protective hood 26*b* is removed. The restoring force can be created in that the blocking element 30 is elastically deformable. However, it is also conceivable for an additional element (not shown), for example a restoring spring, to be integrated.

Figure 5:
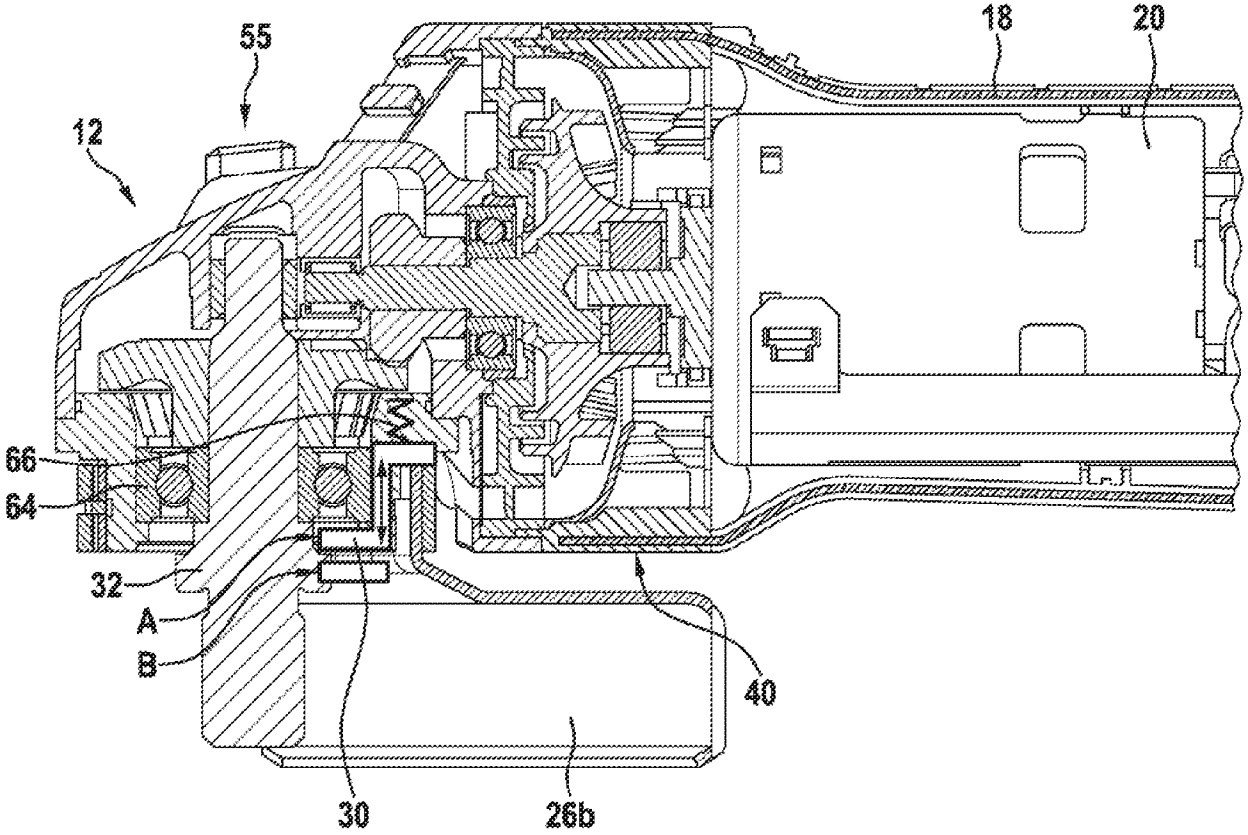
FIG. 5 shows a third embodiment of the portable power tool according to the disclosure and of the contact element in a schematic illustration.

FIG. 5 shows a further embodiment of a portable power tool 10 having a blocking element 30 and a mechanical element 32.

In the exemplary embodiment in FIG. 5, the mechanical element 32 is an output shaft 32 which is embodied as a spindle.

The blocking element 30 is mounted in a translational manner in a bearing flange 64. If the protective hood 26*b* is fitted, the blocking element 30 is subjected to a force F and moved from the position B into the position A, as can be seen in FIG. 5. In this way, a form fit with the spindle 32 is released.

A restoring force ensures that the blocking element 30 returns into its starting position when the protective hood 26*b* is removed. The restoring force is created by a restoring spring 66.

In the embodiments according to FIGS. 1, 4 and 5, a combination with a spindle lock 55 of the portable power tool 10 is possible for example. Thus, the spindle lock is released when the accessory 26 is fitted.

If the portable power tool 10 has a brake system, the brake is releasable only in the fitted state of the accessory 26.

Figure 6:
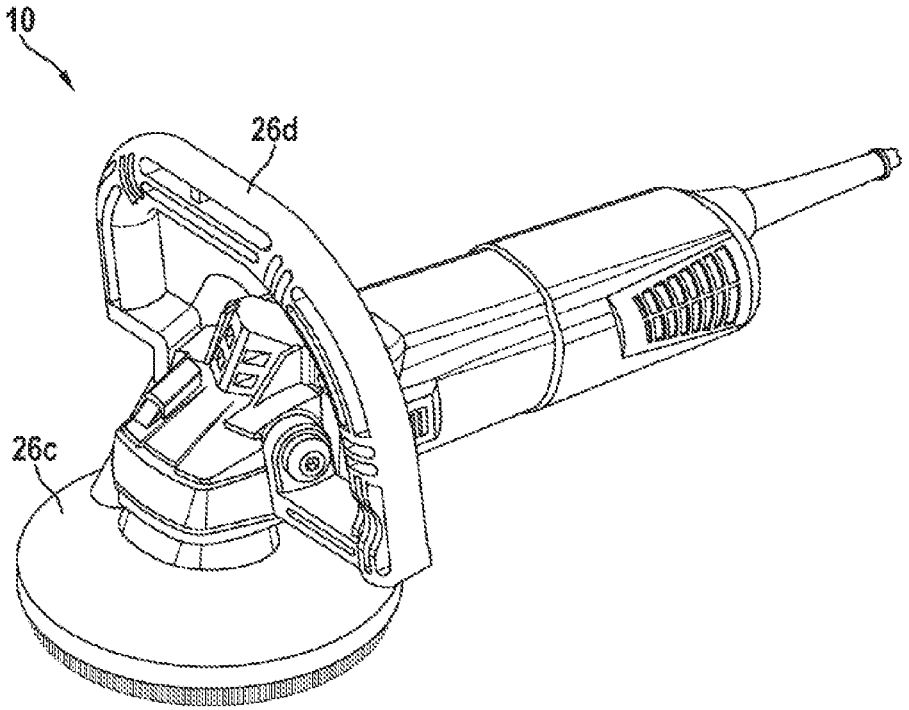
FIG. 6 shows a portable power tool according to the disclosure with two further embodiments of the accessory.

FIG. 6 shows a portable power tool 10, wherein the accessory 26 is embodied as a bail handle 26*d* or as a suction hood 26*c*. Combinations of the accessory of the exemplary embodiments in the figures are also conceivable. Thus, it is conceivable for a portable power tool 10 to be equipped with a protective hood 26*b* and a bail handle 26*d*. It is just as conceivable for a portable power tool 10 to be equipped with an auxiliary handle 26*a* and a suction hood 26*c*.

The invention claimed is:

1. A portable power tool, comprising:

a transmission housing part including at least one machine-side contact element;

a mechanical element;

a blocking element arranged in the transmission housing part and movable between a first position configured to mechanically block movement of the mechanical element such that the portable power tool cannot function, and a second position whereat movement of the mechanical element is not blocked by the blocking element; and an accessory including at least one accessory-side contact element configured to be removably connected to the transmission housing part by the machine-side contact element, the accessory configured to contact the blocking element to move the blocking element from the first position to the second position when the accessory is fitted on the portable power tool, and the at least one machine-side contact element is configured to contact the at least one accessory-side contact element.

2. The portable power tool as claimed in claim 1, wherein the mechanical element includes a switch element.

3. The portable power tool as claimed in claim 2, wherein the switch element is a sliding switch.

4. The portable power tool as claimed in claim 1, wherein the mechanical element includes a mechanical shaft.

5. The portable power tool as claimed in claim 4, wherein the mechanical shaft is a motor shaft.

6. The portable power tool as claimed in claim 1, wherein the mechanical element includes an output shaft.

7. The portable power tool as claimed in claim 6, wherein the output shaft is a spindle.

8. The portable power tool as claimed in claim 1, wherein:

the blocking element includes a stop; and the mechanical element is configured to move against the stop of the blocking element when the accessory is not fitted on the portable power tool.

9. The portable power tool as claimed in claim 1, wherein the blocking element includes a rotary joint.

10. The portable power tool as claimed in claim 9, wherein:

when the accessory is fitted on the portable power tool, the blocking element is subjected to a force; and the blocking element is configured to be moved about an axis of rotation of the rotary joint.

11. The portable power tool as claimed in claim 10, wherein, in response to the blocking element rotating about the axis of rotation of the rotary joint, a stop of the blocking element is moved, such that the mechanical element is configured for movement in a direction of the transmission housing part and to switch on the portable power tool.

12. The portable power tool as claimed in claim 1, wherein the accessory is a handle.

13. The portable power tool as claimed in claim 12, wherein the at least one accessory-side contact element is a threaded pin of the handle.

14. The portable power tool as claimed in claim 1, wherein the accessory is a protective hood.

* * * * *